US006378765B1

(12) United States Patent
Sutherland

(10) Patent No.: US 6,378,765 B1
(45) Date of Patent: Apr. 30, 2002

(54) CARTON PANEL LOCK

(75) Inventor: Robert L. Sutherland, Kennesaw, GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/756,962

(22) Filed: Jan. 9, 2001

(51) Int. Cl.[7] ..... B65D 5/02
(52) U.S. Cl. ..... 229/198.2; 206/427; 229/103.2
(58) Field of Search ..... 229/103.2, 198.2; 206/140, 427, 434

(56) References Cited

U.S. PATENT DOCUMENTS 3,375,968 A * 4/1968 Weiss ..... 206/140
4,526,316 A * 7/1985 Sutherland ..... 206/140
4,708,284 A * 11/1987 Sutherland et al. ..... 229/198.2
5,653,341 A * 8/1997 Miret ..... 229/103.2
5,682,995 A * 11/1997 Sutherland ..... 206/140
5,855,318 A * 1/1999 Baxter ..... 229/198.2
5,924,628 A * 7/1999 Oliff ..... 229/198.2
5,931,300 A * 8/1999 Sutherland ..... 206/427
5,941,453 A * 8/1999 Oliff ..... 229/103.2

* cited by examiner

*Primary Examiner*—Gary E. Elkins

(57) ABSTRACT

This invention relates to a single stage locking arrangement in which the male lock is formed from the terminal edge of one flap and the female lock is located in a second flap and has a unique locking ledge located on an S-shaped cut line extending from the ends of the main cut line of the female lock.

12 Claims, 4 Drawing Sheets

CARTON PANEL LOCK

BACKGROUND OF THE INVENTION

1. Field of the Invention

This invention relates generally to mechanical locks for holding overlapping flaps of a wrap-around carton in place. More particularly, it is a single lock without a "backup" locking system. The female lock has a unique locking ledge on an S-shaped cut line.

2. Prior Art

When fabricating a carton from a paperboard blank, opposite ends of the blank are conventionally attached to each other by glue or by a mechanical lock to form the bottom panel of the carton. In the case of a wrap-around carton, flaps located on the ends of the blank typically are overlapped and engaged with one another by mechanical locks formed in the flaps to form the bottom panel of the carton. Since the bottom panel must maintain its integrity throughout the use of the carton, it is essential that the locking system be capable of supporting the weight of the packaged articles, and remain engaged during shipping and handling of the constructed carton.

One approach to provide a stable mechanical lock assembly utilizes both primary and secondary locks. An example of such locking system is disclosed in U.S. Pat. No. 5,443,203 to Sutherland.

While the combination of a primary and secondary locking system may add to the security of a package, it is also somewhat redundant, like wearing both a belt and suspenders. It would be advantageous to provide a single lock locking system that is secure for a number of reasons. In the first place, a single lock locking system will enable less paperboard to be used in constructing a carton. Secondly, it is less complex to mechanically lock a single lock locking system than where you have both primary and secondary locks. With some types of small containers there is not a lot of room on the bottom panels of the carton to include a primary lock along with a secondary lock. Furthermore, the added security of having both the primary and secondary locking system may not be needed with containers that are light, such as yogurt and butter tubs.

SUMMARY OF THE INVENTION

Is an object of the present invention to provide a single lock locking system for locking wrap-around cartons. It is the further object of this invention to provide a carton locking system that allows a reduction in the amount of paperboard required to construct the carton. A further object of this invention is to provide a single lock locking system that can be utilized to package small containers in a wrap-around carton.

Briefly described, in its preferred form, the objects of this invention are achieved by providing a single lock locking system. An important feature of this system is the introduction of a locking ledge on a S-shaped cut line in the female lock. A locking shoulder of the male lock which projects from an end of the carton rests on this locking ledge.

These and other objects, features, and advantages of the present invention will become more apparent upon reading the following specification in conjunction with the accompanying drawing figures.

BRIEF DESCRIPTION OF THE DRAWINGS

FIG. 1A is a cutaway view showing in more detail the male and female locks on the ends of the carton.

DETAILED DESCRIPTION OF THE PREFERRED EMBODIMENTS

The present invention is intended primarily for use with wrap-around cartons for containing tubs for such products as yogurt and butter. It may also be used for containing bottles of the type used to contain soft drinks, beer, and the like. A typical example of such a bottle has a generally cylindrical body with an upper portion and a bottom, a tapering shoulder smoothly continuous with the upper portion of the body, and a neck formed on the shoulder having a smaller diameter than the body. This conventional bottle B also has a neck flange projecting outwardly from the neck, and a cap attached to the upper end of the neck flange.

Figure 1:
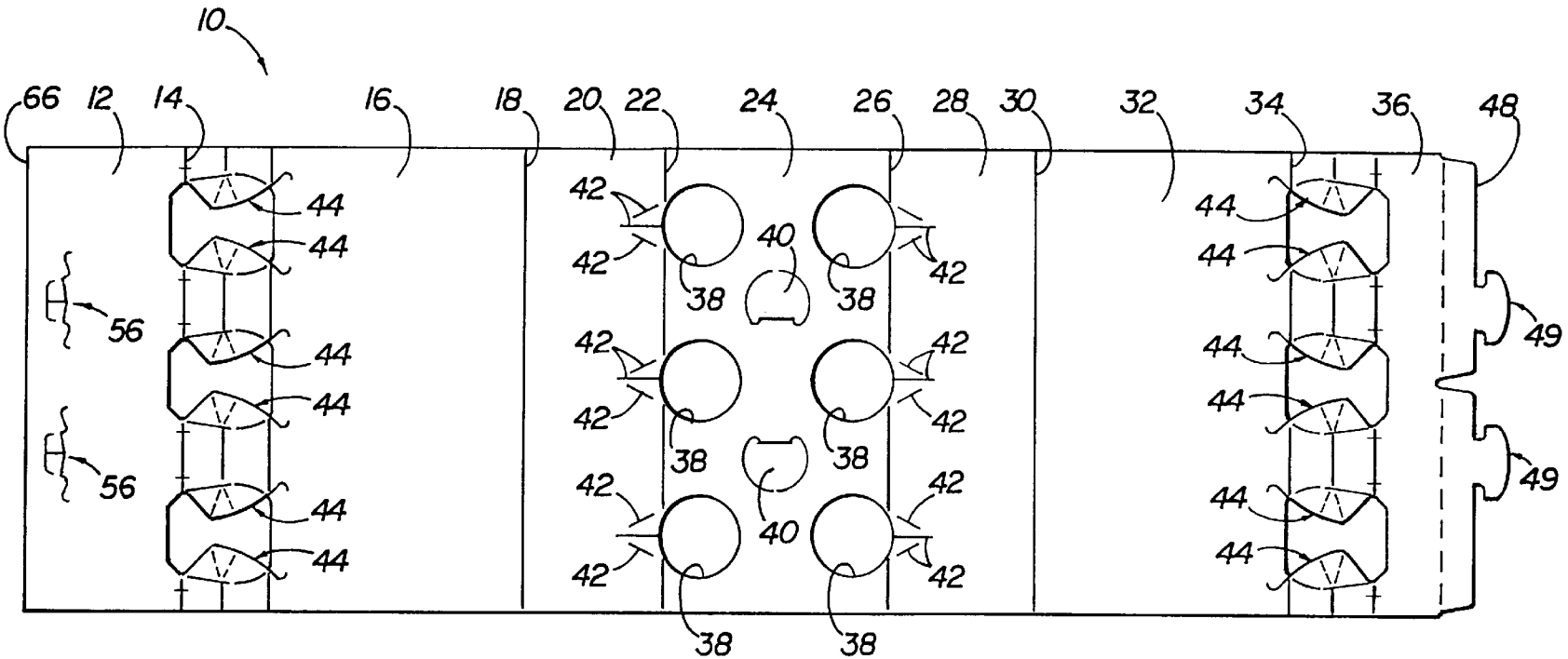
FIG. 1 is a plan view of a blank with a single lock locking system having a female lock with a locking ledge on a S-shaped cut line from which the carton of this invention is formed.

A blank for the wrap-around carton of this invention is illustrated in FIGS. 1 and 1A. When this blank is constructed into a carton, it can contain six beverage bottles arranged in two rows of three each. The blank is formed from a foldable sheet material, such as paperboard. The blank 10 has bottom flap 12 which is connected by fold line 14 to lower side panel 16, which in turn is connected by fold line 18 to upper side panel 20 which is connected by fold line 22 to top panel 24. Top panel 24 is connected by fold line 26 to upper side panel 28, which in turn is connected by fold line 30 to lower side panel 32, which is connected by fold line 34 to bottom flap 36.

Since this carton is designed to carry six bottles, the necks of which extend through the top panel, six apertures 38 are provided in the top panel 24. Finger-gripping apertures may be formed by die stamping of the carton blank 10 wherein tabs 40 are formed. Expansion slits 42 may be formed in upper side panels 20 and 28 to facilitate the expansion of the neck of the bottle B beyond the aperture 38.

It will be understood by those in the art that the blank carton 10 is symmetrical about a horizontal line of bisection, as viewed when FIG. 1 is rotated lengthwise. This symmetry aids in the efficient production of the present carton. The carton need not have such symmetry, although it is preferred. As shown, the blank is rectangular in shape and includes straight edges, which also makes for an efficient layout of the blanks in a web from which the blanks are cut.

Figure 2:
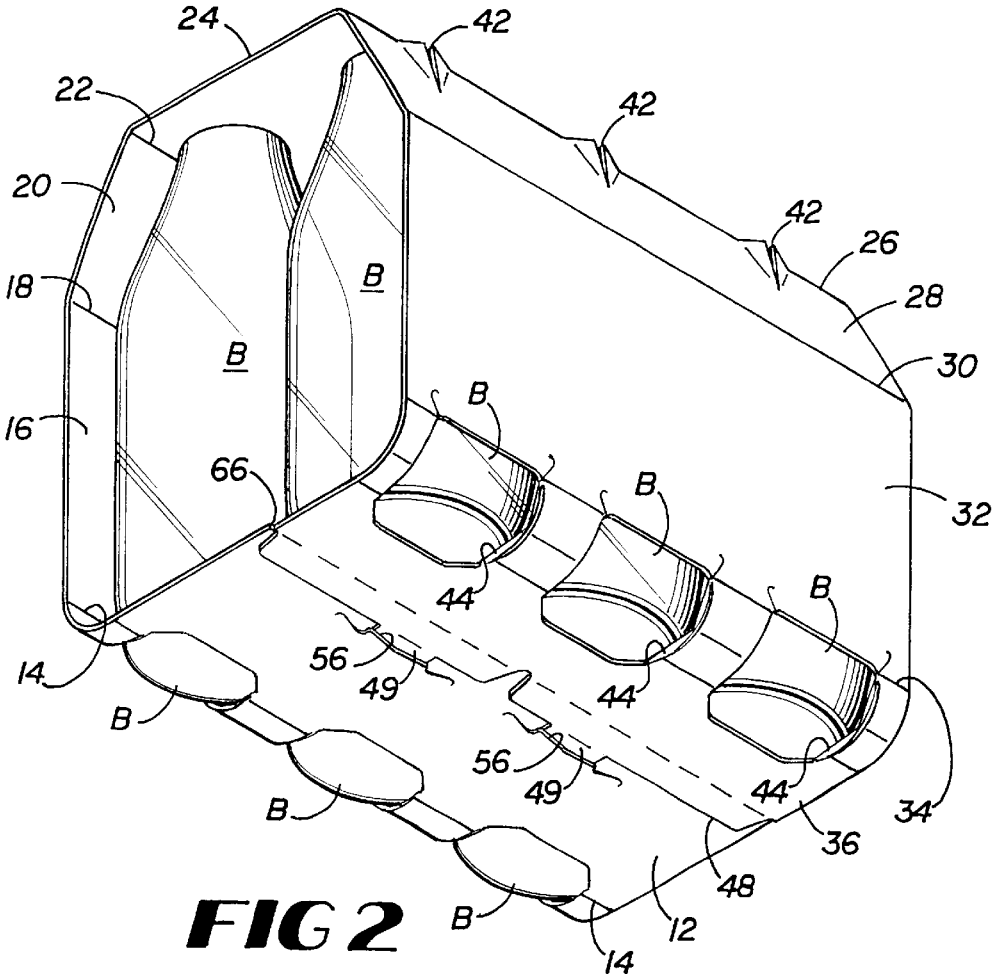
FIG. 2 is a perspective view of a preferred carton in a setup condition and containing bottles, which carton incorporates the single lock locking system of the present invention.

The carton shown in FIG. 1 has heel restraining assemblies 44 for restraining the heels of the contained bottles B. It should be realized that other suitable means for restraining the heels of bottles from falling out of the open ends of the carton can be provided. It is particularly important to restrain the outside bottles from movement as they in turn will restrain the movement of the inner bottles in the carton. As shown in FIG. 1, heel doors 46 are provided in the bottom of each lower side panel 16, 32 and extend into the corresponding bottom flaps 12 and 36. These heel doors 46 open inwardly during the erection of the carton. Fold lines 47 permit the heel doors 46 to be swung inwardly during erection. This permits each bottle B to be nested in between a set of adjacent heel doors 46 of each heel restraining assembly 44. This facilitates holding each bottle in proper position as illustrated in FIG. 2. These doors also tend to restrain tearing around the heel apertures that are formed by these doors. Without these heel doors 46, there would only be cuts that could be easily torn. Further, these doors provide a flexible buffer against which the heel of the bottle can abut without tearing the carton panel surrounding a heel restraining aperture. It should be understood that these heel assemblies may not be needed for certain types of products, or when the ends of the cartons are fully or partially enclosed.

The unique feature of this carton is the single lock locking system as shown in detail in FIG. 1A. Bottom flap 36 has a terminal edge 48 from which there projects a plurality of male locks 49, each of which is aligned with a female lock to be described later. The male locks 49 are joined to bottom flap 36 by fold line 50. While the male lock 49 may vary in configuration, it is understood that it is to be of a headed configuration so as to include a nose 51, rounded side edges 52, and locking shoulders 53 which face, and are spaced from, the terminal edge 48 of bottom flap 36 and are parallel to the terminal edge 48. Each locking shoulder 53 is spaced from the terminal edge 48 of bottom flap 36 by a relatively wide space 54.

The female locking system consists of a female lock 56 in bottom flap 12 which is designed to receive the aligned male lock 49. Each female lock 58 is formed with two cut lines, 58 and 60, that meet at a center point 64 and each slopes gradually toward the terminal edge 66 from its center point 64 to its end 62. This slope facilitates entry of the male lock 49 and assists in holding it in position. Cut line 68 separates two doors 70. These doors 70 are further defined by cut lines 72. These doors are hinged at hinge 71 which may or may not be scored. Cut lines 58 and 60 extend at their ends into reversely curved cut lines 74, which are generally S-shaped, which form locking ledges. The locking ledges 76 extend inwardly or away from the terminal edge 66 from the end 62 of cut lines 58 and 60 to form the locking ledges for holding the locking shoulders of male lock 49 in the locked position. The ends 62 of cut lines 58 and 60 are nearer the terminal edge 66 than the center point 64 and consequently allow the locking shoulder 53 to rest in a locked position on the locking ledge 76 in an overlapping position and be securely locked. The area between the locking ledge 76 and hinge 71 of the doors provides a significant structure for securing the male lock 49 and preventing the locks from breaking.

Although it is preferable to have the doors 70 to help hold the male lock 49 in place, they can be replaced with an aperture.

Figures 3A, 3B, 3C:
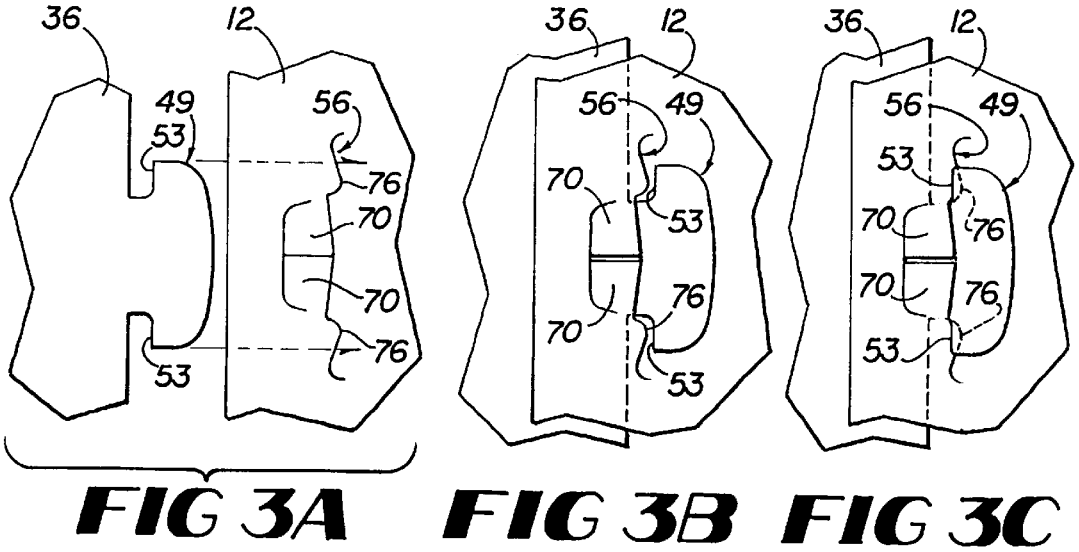
FIG. 3A is a close-up sectional view of the inside of the carton of the male lock about to enter the female lock.
FIG. 3B is a close-up sectional view of the inside of the carton of the male lock inserted in the female lock to the maximum extent.
FIG. 3C is a close-up sectional view of the inside of the carton of the male lock engaged or locked with the female lock.

In operation, as shown in FIGS. 3A–3C, the male lock 49 is engaged with the female lock 56 by being pushed through the doors 70 so that locking shoulders 53 are engaged with and lie inside locking ledges 76 on the aligned female lock 56. In actual operation on the carton erecting machine, the male lock 49 is pushed inwardly beyond its final resting point as shown in FIG. 3B and allowed to relax so that the locking shoulder 53 overlaps and is engaged on the inside of the locking ledge 76 of the female lock 56 (FIG. 3C). In order for the male lock 49 to be inserted into the female lock 56, it is necessary that cut lines 58 and 60 and S-shaped cut lines 74 be cut all the way through the paperboard to form one continuous cut line. It should be understood that the S-shaped cut line 74 is only one configuration in that the only requirement for a successful lock being that the locking ledge 76 must extend inwardly of the ends 62 of cut lines 58 and 60. The S-shaped configuration shown is preferred because it facilitates ease of entry into the female lock 56 by the male lock 49.

Figure 4A:
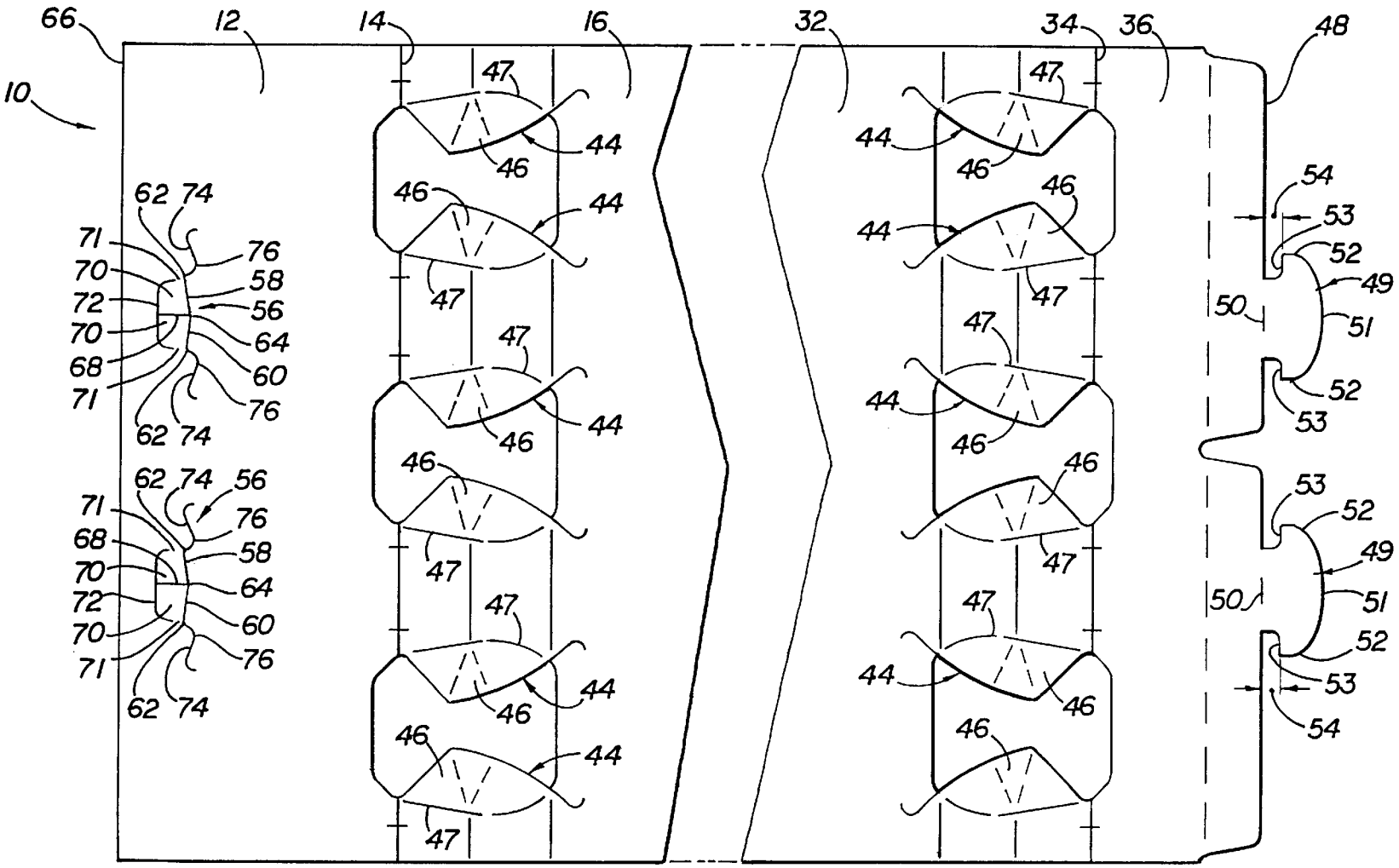
FIG. 4A is a cutaway view of the locking mechanism of an alternative embodiment with three locks in which there is a score line between the S-shaped cut lines of the female locks.
Figure 4A:
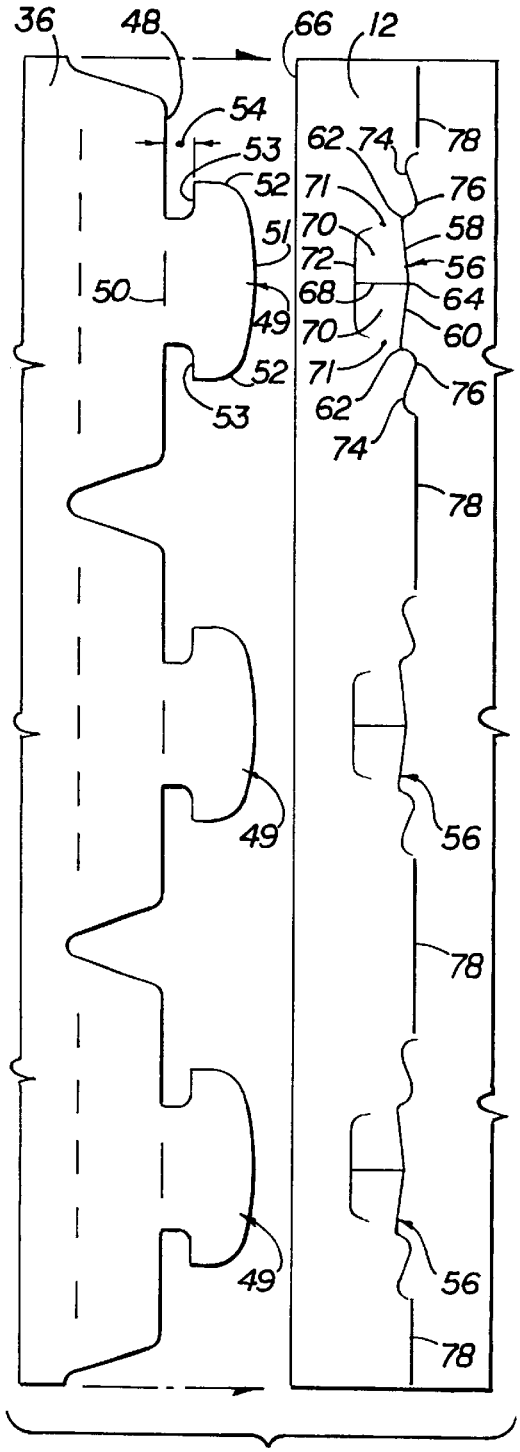
Figure 4B:
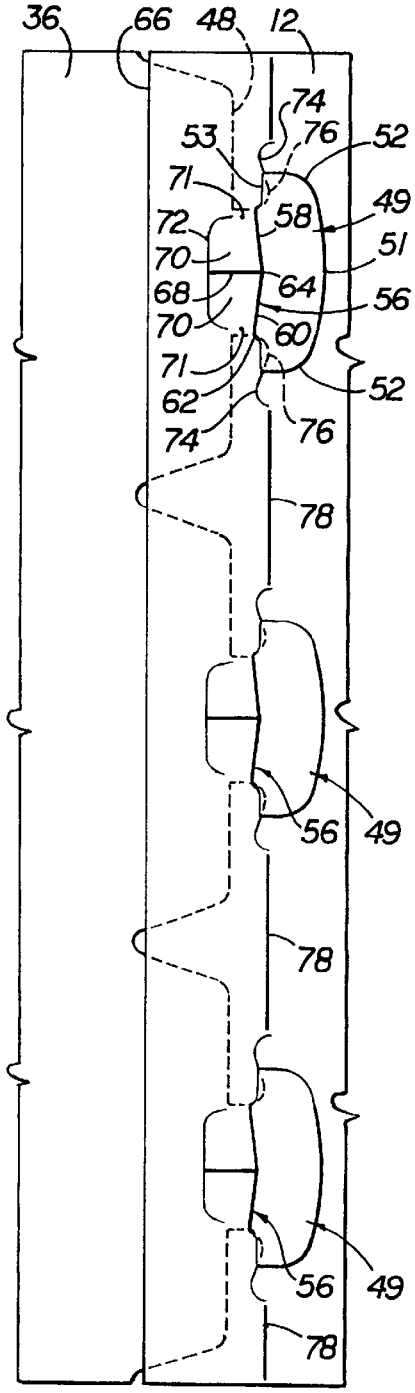
FIG. 4B is a cutaway view showing the male locks locked with the female locks.

As illustrated in FIGS. 4A and 4B, a score line 78 may be provided between the S-shaped cut lines 74 to allow the female lock 56 to be bent to allow entry of the male lock 49. This may be necessary in forming a carton around small containers, such as yogurt and butter.

Formation of the Carton of this Invention

The carton of this invention can be formed around a group of containers on a packaging machine capable of locking the locks. The carton blank 10 is first draped over a group of bottles or other containers. In the case of the blank illustrated by FIG. 1, the apertures 38 are extended over the necks of the bottles which have been grouped together in the arrangement for forming the package. The upper side panels 20 and 28 and lower side panels 16 and 32 are folded downwardly into position along the sides of the bottles B. The heel restraining assemblies are placed in proper position by the folding of heel doors 46 inwardly around the heels of the bottle as is well known in the art.

The male locks 49 are then inserted through the doors 70 of the aligned female lock 56 and pushed through the S-shaped cut line 74 until the locking shoulders 53 of the male lock 49 lie inside the locking ledge 76 of the S-shaped cut line 74. As the nose 51 of the male lock 49 is inserted into cut lines 58 and 60 and S-shaped cut line 74, the doors 70 are pushed slightly inward. The portion of the bottom flap 12 between cut lines 58 and 60 and the heel restraining assembly 44 is bowed slightly outwardly to facilitate the entry of the male locks 49. This outward bowing results in the cut lines 58 and 60 and the S-shaped cut line 74 opening to receive the nose 51 of the male lock. It is possible to pass the nose 51 through what is initially a cut line because the carton is formed of a relatively low caliber paperboard without the male lock 49 folding or collapsing. This constitutes one means of forming the lock of this invention.

The entry of the male lock 49 into the female lock results in bending locking ledges 76 slightly inward to facilitate entry of the male lock 49. Once the locking shoulders 53 clear the locking ledges 76, the locking ledges 76 move back into the plane of the bottom flap 12.

In operation, the carton is compressed so that the male lock 49 extends beyond its resting position in the female lock 56 (FIG. 3A) and then it is allowed to relax in its locked position in which the locking shoulder 53 rests in an overlapping position on the locking ledge 76 of the female lock 56 (FIG. 3C).

Unique Features of the Locking System of this Invention

The single locking system of this invention provides a very secure package in that the locks are firmly engaged with the locking shoulders 53 of the male lock 49 engaging the locking ledges 76. The locking system of this invention resists pulling apart to the point of destroying the integrity of the carton. It has been found that the S-shaped cut lines 74 facilitate entry of the male lock 49 into the female lock

56. The locking ledge 76 formed by the S-shaped cut line 74 firmly engages the locking shoulder 53 of the male lock 49.

The locking system of this invention results in the saving of a substantial amount of paperboard over locking systems that employ both the primary and secondary locks.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A single stage lock arrangement for locking together two flaps, said lock arrangement comprising:

a. a first flap having a first terminal edge and a second flap having a second terminal edge, said first flap having at least one male lock attached to the first terminal edge, said male lock having a nose and two locking shoulders spaced from the first terminal edge; and b. said second flap having at least one female lock in alignment with said male lock, said female lock having a lock cut line with two ends and which is generally parallel to and spaced from the second terminal edge, an aperture adjacent the lock cut line between said lock cut line and second terminal edge for facilitating the entry of a nose of said male lock along said lock cut line, said aperture being closed by two doors which are defined by a door cut line generally parallel to and spaced between said lock cut line and the second terminal edge, said doors being hinged to facilitate the entry of the nose of said male lock along said lock cut line, said lock cut line having a curved cut line extending from each end which curves away from the second terminal edge to define a locking ledge for engaging a locking shoulder of said male lock.

2. The lock arrangement according to claim 1 wherein said curved cut line is generally S-shaped and has an axis disposed generally parallel to said second terminal edge.

3. The lock arrangement according to claim 2 wherein the lock cut line has a center point and gradually slopes from said center point to each end in a direction generally towards the second terminal edge.

4. The lock arrangement of claim 3 in which the doors are separated by a dividing cut line and each door is hinged generally parallel to and spaced from the dividing cut line.

5. The lock arrangement of claim 4 in which the lock cut line and curved cut lines constitute a continuous cut to facilitate the entry of the nose of the male lock.

6. The lock arrangement of claim 5 wherein said female lock has means whereby the male lock can be forced through the lock cut line and curved cut lines so the locking shoulders are in an overlapping relationship to the lock ledges so as to secure the lock arrangement.

7. A blank for wrap-around carton for containing a plurality of containers having a top panel foldably connected to two side panels, one of which is foldably connected to a first flap with a first terminal edge and the other side panel is foldably connected to a second flap with a second terminal edge, said first flap having at least one male lock attached to said first terminal edge, said male lock having a nose and two locking shoulders spaced from said first terminal edge, said second flap having at least one female lock in alignment with the male lock, said female lock having a lock cut line with two ends and which is generally parallel to and spaced from said second terminal edge, an aperture adjacent the lock cut line between said lock cut line and second terminal edge facilitating the entry of the nose of the male lock along said lock cut line, said aperture being closed by two doors which are defined by a door cut line generally parallel to and spaced between said lock cut line and said second terminal edge, said doors being hinged to facilitate the entry of the nose of the male lock along said cut lines, said lock cut line having a curved cut line extending from each end which curves away from the second terminal edge to define a locking edge for engaging a locking shoulder of said male lock.

8. The blank according to claim 7 wherein said curved line is generally S-shaped and has an axis disposed generally parallel to said second terminal edge.

9. The blank according to claim 8 wherein said lock cut line has a center point and gradually slopes from said center point to each end in a direction generally towards said second terminal edge.

10. The blank of claim 9 in which the doors are separated by a dividing cut line and each door is hinged generally parallel to and spaced from the dividing cut line.

11. The blank of claim 10 in which said lock cut line and curved cut lines constitute a continuous cut to facilitate the entry of the nose of the male lock.

12. The blank of claim 11 wherein said female lock has means whereby the male lock can be forced through said lock cut line and curved cut lines so the locking shoulders are in an overlapping relationship to said lock ledges so as to secure the lock arrangement.

* * * * *